United States Patent [19]

Pilgrim

[11] 4,440,613

[45] Apr. 3, 1984

[54] ELECTROPLATING MACHINE

[76] Inventor: Chester Pilgrim, 320 A Summit St., West Reading, Pa. 19611

[21] Appl. No.: 374,004

[22] Filed: May 3, 1982

[51] Int. Cl.[3] ..... C25D 17/02; B65G 49/04

[52] U.S. Cl. ..... 204/206; 204/209

[58] Field of Search ..... 204/206–211, 204/286–289

[56] References Cited

U.S. PATENT DOCUMENTS

| | | | |
|---|---|---|---|
| 1,549,233 | 8/1925 | Todd | 204/288 |
| 1,614,562 | 1/1927 | Laise | 204/129.35 |
| 1,803,691 | 5/1931 | Brockway | 204/210 X |
| 1,991,838 | 2/1935 | Billiter | 204/269 |
| 2,384,660 | 9/1945 | Ward | 204/206 |
| 2,742,417 | 4/1956 | Shanley | 204/211 |
| 2,762,763 | 9/1956 | Kenmore et al. | 204/206 |
| 3,579,430 | 5/1971 | Lawler | 204/206 |
| 3,689,384 | 9/1972 | Barbato et al. | 204/286 |
| 3,867,562 | 2/1975 | Fischer et al. | 204/286 |

FOREIGN PATENT DOCUMENTS

| | | | |
|---|---|---|---|
| 570409 | 2/1933 | Fed. Rep. of Germany | 204/206 |
| 19586 | of 1891 | United Kingdom | 204/206 |

*Primary Examiner*—Howard S. Williams
*Assistant Examiner*—T. L. Williams
*Attorney, Agent, or Firm*—Darby & Darby

[57] ABSTRACT

A wire plating machine includes a tank whose interior walls are covered with insulation and which contains an electrolyte bath. Positioned on the bottom of the tank is a positive insulated electrode which creates positive ions, e.g., tin. A wire is drawn through the tank in a relatively straight line and is given a negative charge, while still in the bath, by passing it into a series of insulating housings along its path of travel. Within the housings there are elongated rods in contact with the wire and connected to a negative potential via shunt straps that pass through insulated tubes out of the bath to a voltage source. Upon leaving the bath, excess electrolyte is removed from the wire and it is subjected to a neutralizing rinse. Then the wire is wound up on a capstan of an intermediate drawing machine. If desired, the wire is reduced in the drawing machine and then passed, first one way and then the other, through the electrolyte bath again, while being periodically recharged in additional insulating housings along its path of travel. This reduced wire with additional plating is wound up on a second capstan of the drawing machine. Thus, the power needed to move the wire is produced by the drawing machine and the wire is recharged without having to remove it from the bath.

18 Claims, 6 Drawing Figures

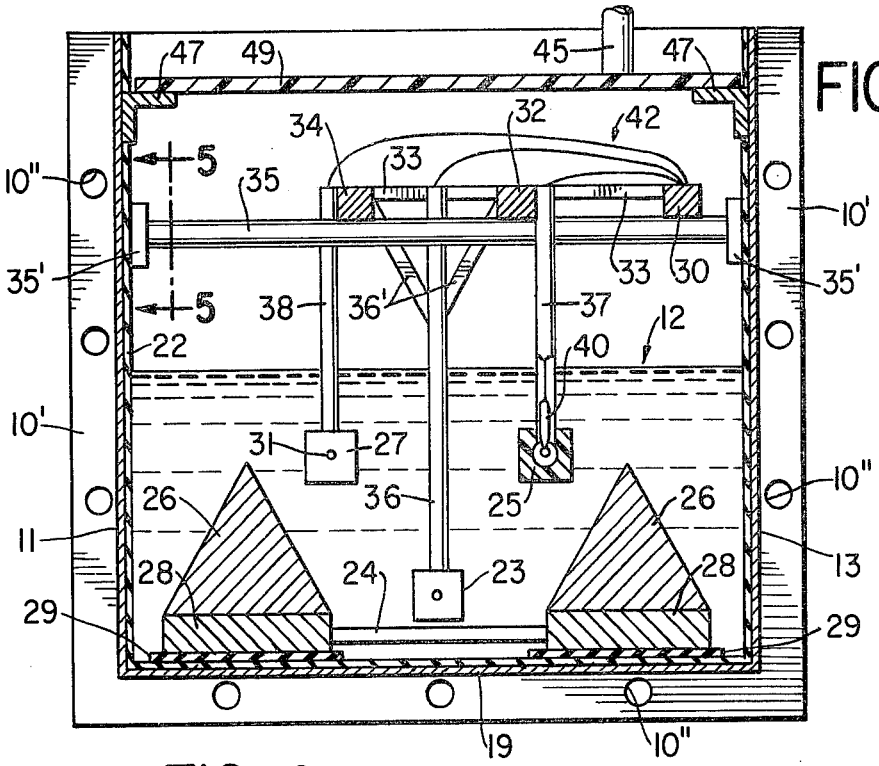
FIG. 3
FIG. 4
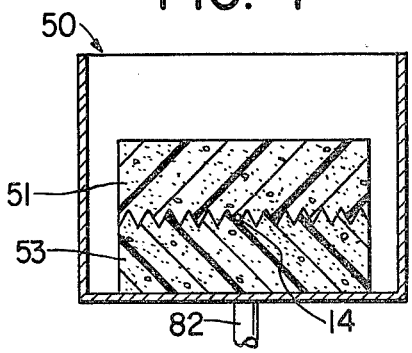
FIG. 5
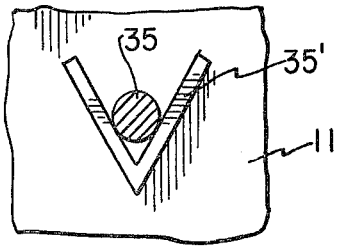
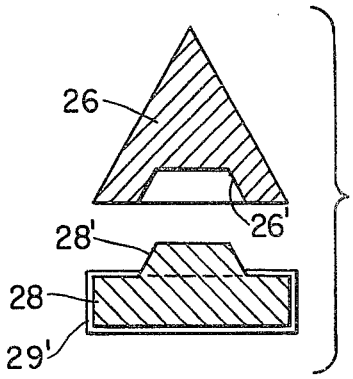
FIG. 6

ELECTROPLATING MACHINE

BACKGROUND OF THE INVENTION

The present invention relates to electroplating and, more particularly, to the high speed, continuous electroplating of wire.

Typically the electroplating of wire involves applying a negative electrical charge to the wire so that it becomes a cathode and then passing the wire through an electrolyte bath that contains a positive electrode or anode. This anode creates positive metallic ions which are attracted to the wire and plate it. This process is often repeated by passing the wire through the bath several times or by passing it through other electrolyte baths arranged in series with the first.

After each such pass through a bath, the wire is brought out of the electrolyte and into contact with a negative electrode to reestablish the negative electrical charge that is needed to attract additional positive metal ions in the succeeding bath. This recharging of the wire cannot be done in the bath because the cathode itself would become plated with the positive metal ions. However this recharging is necessary because the positive metal ions that reach the wire have their charge neutralized as they are deposited on the wire. This neutralization of the ion charge creates a charge barrier to the accumulation of additional ions, which barrier is overcome by recharging the coated surface of the wire.

Various means have been proposed for charging wire prior to passing it through an electroplating bath. These include passing the wire over electrically charged rollers or through charged beds located outside the bath. See for example U.S. Pat. No. 3,947,343 to Delves-Broughton et al. As a result, the wire must be bent significantly a number of times as it passes back and forth through the bath or through subsequent baths. This bending requirement creates a limit on the gauge of the wire that can be used in such a process. Further heavy duty machines must be used to move the wire through these baths because of the resistance offered by the bends in the wire. Consequently, it is possible to stretch and break the wire unintentionally, especially in a high speed wire plating operation. It should also be noted that the longer the wire remains in the electroplating bath without being recharged, the less it is capable of attracting metal ions to its surface. Therefore, there is a limit to the length of the bath or the period of time in which the wire should be kept in the bath in order to assure efficient operation.

SUMMARY OF THE INVENTION

The present invention is directed to providing a means by which a wire to be electroplated may be recharged while still within the electrolyte bath of an electroplating machine, so that the number of bends in the wire is greatly reduced, thereby permitting the use of larger diameter wire and longer plating times or bath lengths. Further the present invention seeks to reduce the amount of energy needed to draw a wire through an electroplating machine. These objects are achieved according to the present invention by recharging the wire along a substantially linear path of movement by passing it into insulating housings located in the bath and by providing a recharging source within each insulating housing such that a charging space is created therein which is isolated from the general charging space of opposite polarity in the electrolyte bath.

In an illustrated embodiment of the invention, an electroplating machine includes a tank for containing an electrolyte bath. Located within the tank is a first electrode which provides metallic ions having an electrical charge of one polarity. The wire is removed from a spool and is drawn in a generally straight path through the tank to an exit port. While moving through the tank, the wire passes through one or more insulating housing which are within the bath itself. These housings allow the wire to pass through, but substantially prevent the metal ions from coming into contact with wire within the housing. A second electrode means is located at least partially within the insulating housing and is used to impart an electrical charge to the wire of opposite polarity to that of the metallic ions. The wire is then withdrawn from the tank using the power of a machine which has some other purpose, for example, an intermediate drawing machine.

In a preferred embodiment, the wire is reduced in diameter, i.e. increased in gauge, in the intermediate drawing machine and is then passed back into the electrolyte bath. During this pass through the bath, the wire moves through additional sets of insulating housings and is recharged. Upon reaching the opposite end of the tank, the wire may either be removed or bent around into the opposite direction and passed along the entire length of the tank once more. During this third pass through the tank, further insulating housings are provided for recharging of the wire. As a result, the wire is plated first at one diameter and then is drawn down to a smaller diameter. This drawing operation tends to change small uncovered spots on the originally plated wire into substantially lengthened oval shapes in the reduced wire, which oval shapes are easily plated during the second pass through the bath. Further, the recharging of the wire within the insulating housings allows the bath to be of great lengths, since the efficiency of the plating operation is maintained by recharging the wire at regular intervals.

Preferably, the anodes for producing the metallic ions in the electrolyte bath rest on the longitudinal members of a ladder-shaped arrangement of insulated conductors on the bottom of the electrode tank, which longitudinal members have raised projections of bare metal for attachment to recesses in the bottoms of the metal anodes that rest on top of them. A ladder-like arrangement of conductors is also provided above the bath, but within the tank, for supplying an electrical charge to the wire from a power supply. In one preferred form the charge on the wire is achieved by means of an elongated member which rides on the wire within the insulating housing and is slidably positioned within an externally insulated metal tube extending from the insulating housing out of the bath. The elongated member that rides on the wire is connected by a shunt to one of the power supply conductors and the metal tube is also connected to the conductor arrangement.

Between the intermediate drawing machine or other wire moving device and the tank containing the electrolyte bath, there is positioned a wiper for removing excess electrolyte from the wire, and a neutralizing rinse section for neutralizing the chemicals on the wire. The wiper may comprise two sections of foam material with mating surfaces that are urged together, with wire passing between them. A reservoir tank positioned below the electrolyte bath collects excess electrolyte from the wiper section and from the tank itself for storage. The electrolyte may be refreshed in the reservoir and a pump may be provided for recirculating this liquid back into the electrolyte bath.

BRIEF DESCRIPTION OF THE DRAWINGS

The foregoing and other features of the present invention will be more readily apparent from the following detailed description and drawings of an illustrative embodiment of the invention in which:

FIG. 3 is a cross sectional view of the plating tank of FIG. 1 along line 3—3;

FIG. 4 is a cross sectional view of the wiper section of the apparatus of FIG. 1 along line 4—4;

FIG. 5 is enlarged detailed cross sectional view of the support for the cathode members taken along line 5—5 of FIG. 3; and FIG. 6 is an exploded sectional view of an anode according to the present invention showing its raised portion.

DESCRIPTION OF AN ILLUSTRATIVE EMBODIMENT

Figure 1:
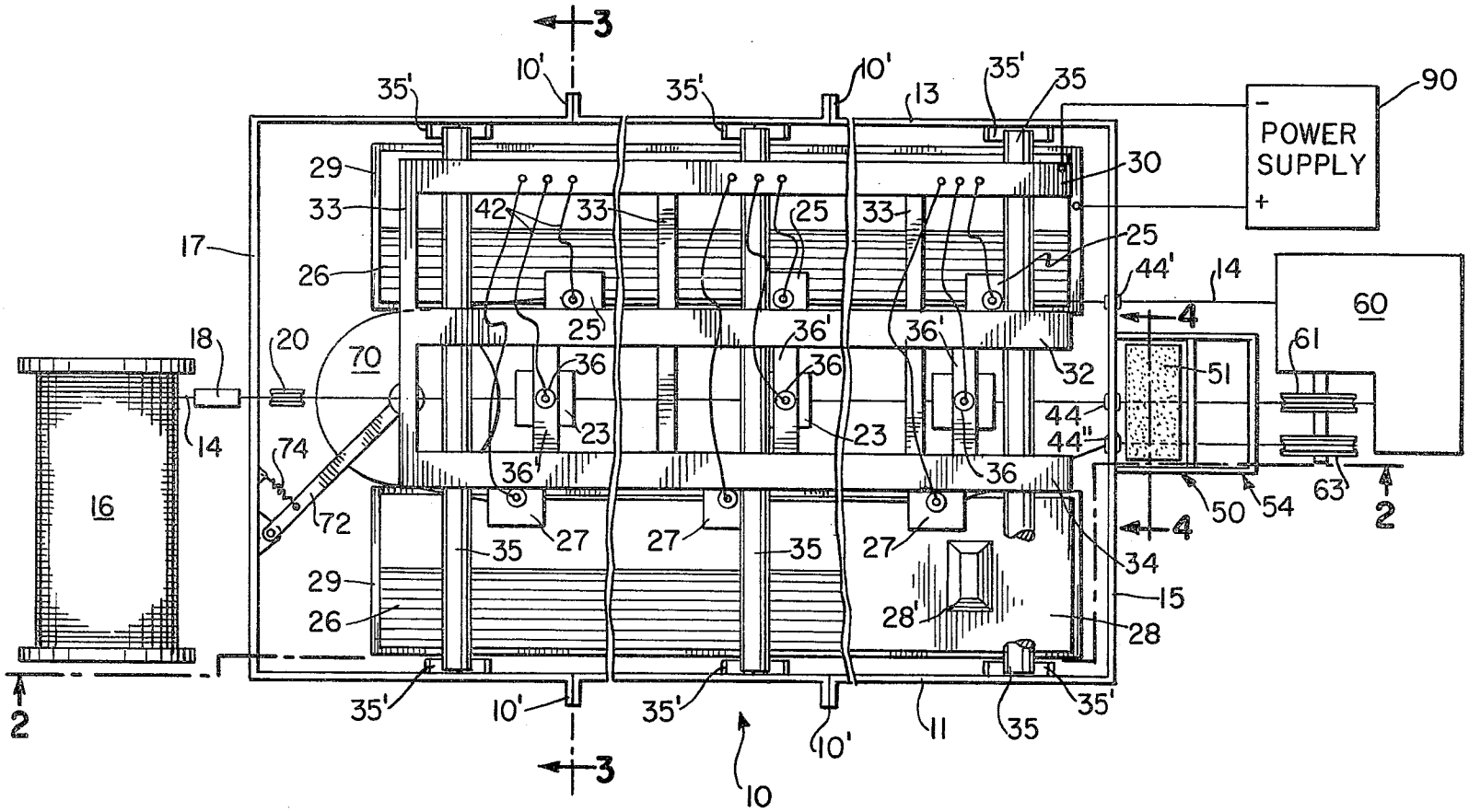
FIG. 1 is a top view of a wire plating machine according to the present invention.
Figure 2:
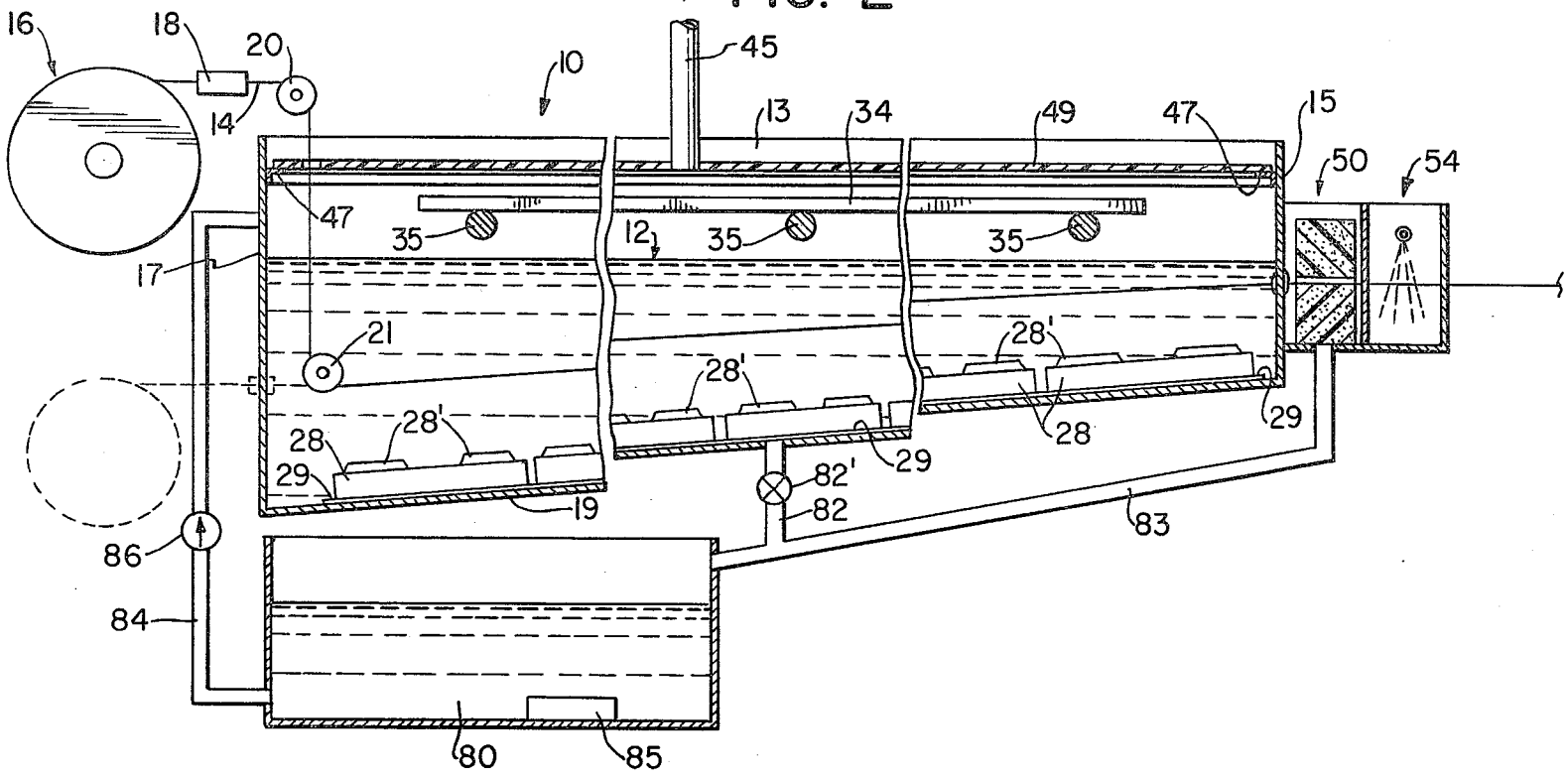
FIG. 2 is a side sectional view taken along line 2—2 of FIG. 1 of the present invention.

As shown in FIGS. 1-3, the electroplating machine includes a trough or tank 10 made, for example, of cold rolled steel, which tank holds an electrolyte solution or bath 12 for electroplating wire 14. The tank includes side walls 11, 13, end walls 15,17 and a bottom 19. In FIG. 1 only portions of the tank 10 are shown, which tank may be exceptionally long, for example, 40 to 50 feet, and may have a width and depth in the neighborhood of 14 to 18 inches. To aid in assembling such a large tank, it is made from uniform sections that may be 80 inches long and which have flanges 10' that may be bolted together with a sealing means between them. For this purpose, bolt holes 10" are provided in the flanges. The interior of this tank which contains the electrolytic bath is coated with an insulating material 22, for example, rubber.

The wire to be coated is shown on a supply spool 16 in FIGS. 1 and 2. This wire passes through guides 18 and over a pulley 20 which directs it downwardly into the bath. A pulley 21 located below pulley 20 then redirects the wire 14 into the longitudinal direction of the bath at a position close to the center of the tank and just above its bottom 19. If the gauge of the wire is such that this bending should be avoided, the spool 16 can be lowered to the height of pulley 21 as shown in dotted line in FIG. 2 and the wire can be passed through a grommet in end wall 17 of the tank.

The wire may be initially charged before it enters the tank, i.e. as it passes over pulley 20, or it may first be charged when it enters the first of a series of insulating housings 23. While within each housing 23 the wire, which may be copper, can be given a charge, for example a negative charge. Upon leaving each insulating housing, this charged wire passes through the electrolyte solution which contains metal ions, for example, positive tin ions generated by an anode arrangement 26 (see FIG. 3).

Anode 26 is in the form of two members with triangularly-shaped cross sections that extend along the opposite side walls of the tank. Each of the two anode members is made of the plating material, e.g. tin, lead-tin, nickle or silver, and has recessed areas 26' (FIG. 6) at spaced locations along its length. Each recessed area is adapted to fit over mating raised areas 28' of longitudinal conductor members 28 that may be formed from anode grade copper. In FIG. 1, the anode 26 has been removed from a portion of conductor 28 so as to show the trapezoidal-shaped raised area 28'. In a typical example, the raised areas and recesses may be provided along the conductor 28 and anode 26 at increments of about 20 to 25 inches. In addition, to aid in the assembly of the two anodes and the conductor, the members 26 and 28 of each are made in sections of, e.g., 30 inches in length, which are then connected together. The anode sections are slightly wider than the conductor to provide an overhang that makes the removal of the anode easier.

An equal potential is assured for the two anodes and the conductors by means of cross connectors 24 which are spaced about every 50 inches and which connect the conductors 28 of each anode arrangement into a ladder-like framework. The conductors may either rest on insulating pads 29 as shown in FIG. 3 or they may be completely coated with insulating material 29', except for the raised portion, as shown in FIG. 6.

A high capacity positive voltage source, e.g. power supply 90 in FIG. 1, is connected to the conductors 28 and, as a result, positive metal ions are produced in the electrolyte bath 12. If the wire 14 is made of copper and is given a negative charge in the insulating housings 23, the wire may be coated with tin by forming electrodes 26 out of that metal and by giving conductor 28 a positive potential. Tin anodes can be formed by pouring molten tin into V-shaped molds. While the metal is hot an iron form with two trapezoidal areas is then placed on top of the casting to form the recesses.

Because of the difference in polarity, the positive tin ions are attached to the negatively-charged copper wire and begin to coat it. As wire 14 is moved along the length of the bath, the accumulation of tin ions on its surface forms a plating, but it also acts to neutralize the surface charge on the wire so that additional ions of tin are not as readily attracted. To prevent a significant drop in plating efficiency, additional insulated housings 23 are be provided along the path of the wire at convenient intervals as shown in FIG. 1.

In order to supply negative charge to the wires, a ladder-like array of negative bus bars is established. These include longitudinal bus bars 30, 32 and 34 as well as cross connectors or bars 33, all of which may be made from anode grade copper. The cross bars 33 may be spaced about every 40 inches. For the sake of convenience and ease of construction, the longitudinal bus bars are formed in segments which are electrically connected together. The bus bars 30, 32, and 34 which form the negative current source are supported above the level of the electrolyte bath by means of rods or bars 35. These bars are supported from the side walls of the tank via V-shaped brackets 35' as best shown in FIG. 5.

As best shown in FIGS. 1 and 3, a series of tubes 36 are mounted from the longitudinal bus bars 32 and 34 via struts 36' so as to extend into the insulating housings 23. In addition, two other series of tubes 37, 38 are directly connected to bars 32 and 34 and extend into neighboring series of insulating housings 25,27. The tubes 36, 37 and 38 are, for example, made of copper, but their outer surfaces are coated with an insulating material, such as rubber, to a height of at least 2 or 3 inches above the bath. The insulating housing at the ends of each tube is typically a rubber block about 3-4 inches long which has an interior cavity with about a ½ inch diameter, as best shown by block 25 in FIG. 3. The wire enters and leaves this cavity through metal grommets 31 which prevent substantial amounts of the metal ions from entering the cavity. As the wire passes through the cavity of each insulating housing, it is in contact by an elongated cigar-shaped member 40, which preferably is made of beryllium copper. This elongated member is connected via a shunt strap 42 to the bus bar 30. As a result, a negative charge is applied to the wire without applying undue strain on the wire and without changing its direction significantly.

After the wire passes through the bath and the series of insulated housing 23 at a level close to its bottom and near its center, it extends through a grommet 44 in end wall 15 of the tank and passes into a wiper section 50. A cross section of the wiper section 50 is shown in FIG. 4. In general, it is two sandwiched sections 51,53 of rubber or sponge material with matching corrugations in contact with each other and with the wire passing between them. After leaving the wiper section, the wire passes into a rinse section 54 where an aqueous alkali neutralizing solution, e.g. sodium carbonate ($NaCO_3$) or sodium hydroxide (NaOH) is sprayed over the wire to eliminate the effects of the chemicals in the electrolytic bath.

The entire electrolyte bath over its length is covered by a flexible elastic member 49 which rests on angle brackets 47. As a result, noxious fumes from the electroplating process are retained within the tank. If it is desired to remove these fumes from the tank without harming the surrounding environment, they may be drawn off through a suction duck 45 which may exhaust them at a safe distance from the plating operation after they have been cleaned by various processes known in the art.

After the wire has passed through the wiper section 50 and the rinse section 54 it enters an intermediate drawing machine 60 then is wound up on the normal capstan or pulley 61 of the intermediate drawing machine 60. This drawing maching is capable of drawing wire gauges down to smaller sizes and is well known in the art. Since the drawing machine is used to move the wire through the electroplating apparatus, there is no need to provide independent driving rollers for the wire. Thus there is an overall savings in the energy, space and cost involved in the process. Further, various gauges of wire can be plated, thus favorably affecting the economy and productivity of the system.

After the wire is reduced in size, it can again be passed through the electrolyte bath to additionally plate it. This has a particular advantage because small spots in the covering of the wire at one gauge will be turned into elongated areas when the wire is reduced. Thus, passing the wire through the bath the second time will allow these areas to be completely covered.

When the wire passes through the intermediate machine 60, it can be made to reenter the electrolyte bath through a second grommet 44' in end wall 15 as shown in FIG. 1. When this is done, the wire passes through the series of aligned insulating housings 25 until it reaches the end wall 17 of the tank. Then it can be removed from the bath, wiped and neutralized or it can be turned about a pulley 70 and returned towards end wall 15 of the tank. In passing towards end wall 15, the wire is recharged in the other series of aligned insulating housings 27 positioned along its path of travel. The pulley 70 which permits the wire to pass from the series of insulating housings 25 into the housings 27 is spring loaded under tension so that there is no slack in the wire. This spring loading is by means of pivotal lever 72 and spring 74. The large pulley 70 could be replaced with two smaller pulleys positioned near end wall 17, but this would increase the undesirable bending of the wire.

After the final pass through the electroplating bath, the wire passes through a third grommet 44'' in end wall 15, the wiper section 50 and the rinse section 54 to a further capstan or pulley 63 placed on the same shaft as the normal capstan 61 of the intermediate machine. From pulley 63 the wire can be run through the electroplating bath an additional time, if necessary, or it can be removed from the system.

As shown in FIG. 1, the insulating housings appear to be uniformly spaced along the wire path both during the first pass through the electrolytic bath and during the optional second and third passes. However, this need not be the case. In particular, the recharging insulating housings of each series of housings 23, 25 and 27 can be grouped closer together in one portion of the bath than in another. Grouping of these housing closer together results in a higher charge on the wire in that area, which causes faster plating with coarser grains. In the area of the bath in which the spacing of the insulating housings is at greater distances, so that recharging is less frequent, the deposit of metal ions on the wire occurs at a slower rate and a much finer grain is deposited. By varying these areas throughout the wire, a finer grain can first be laid down on the wire and then covered with a heavier and thicker covering at a later period of time.

As best shown in FIG. 2, a reservoir 80 is located below the tank containing the electrolyte bath. A conduit 82 connected to the tank via a valve 82' and a conduit 83 connected to the wiper section 50 allow the electrolyte to be returned to reservoir 80. In the reservoir 80 the electrolyte can be reconditioned by the addition of chemicals, chilled by a conventional device 85 and then returned to the tank over conduit 84 by a pump 86.

The establishment of repeated cathodic contact with the wire while in, but separated from, the electrolyte solution that contains the anions, represents a unique arrangement in the plating of wire. The effects achieved by this unique arrangement include the elimination of (i) the need for the repeated exit and entry of the wire from the bath whenever recharging is necessary and (ii) the conventional contact drums typically used to charge the wire. As a result the stress that the conventional drums apply to the wire when it is looped over them is relieved and also the absence of the loops permits the apparatus to handle larger sizes of wire. By allowing the recharging of the wire to occur in one long tank there is no need for a series of separate tanks with separate solutions.

The use of an intermediate drawing machine to move the wire results in the elimination of the need for independent wire moving devices and constant tension control devices. Also, if such a machine is already available or needed in the wire plant, there is a savings in capital expense, since the machine will perform two functions. Maintenance costs and space are kept low because the arrangement is simple and applys little tension to the wire.

Apparatus according to the present invention produces wire with an improved finish because the plating is applied in two steps and each step is performed when the wire is at a different diameter. Since the wire can remain in the bath for a longer period of time without slowing down production, due to the fact that the tank can be made very long, less current can be used. This results in a finer grain deposit and the consumption of less plating material. Further, a lower power current supply can be used.

While the present invention has been particularly shown and described with reference to a preferred embodiment thereof, it will be understood by those skilled in the art that various changes form and details may be made therein without departing from the spirit and scope of the invention.

What is claimed is:

1. A wire electroplating machine comprising:

a continuous electrolyte bath contained in a tank with a bottom, two side walls and two end walls;

means for moving the wire through said continuous electrolyte bath and positioned to receive the wire after it has passed through said bath;

a first electrode means located in said bath so as to create a first charging area and providing metallic ions having an electrical charge of one polarity, said first electrode means including (a) at least one longitudinal metallic conductor, said longitudinal conductor having upwardly raised contact areas at spaced apart locations along the top surface thereof, (b) means for insulating the longitudinal conductor from the tank containing the electrolyte bath, (c) at least one longitudinal metallic ion producing metal bar having recesses at spaced locations along its bottom which correspond to the raised areas of said longitudinal conductor, said bar being mounted on said longitudinal conductor such that there is electrical contact between the raised areas of the conductor and the recesses of the bar, and (d) a source of electrical potential connected to said longitudinal conductor;

at least one insulating housing located in and surrounded by said bath, said housing being positioned such that the wire passes through the housing without substantial deviation from a straight path and without permitting a substantial number of metallic ions to enter the housing from the continuous electrolyte bath; and a second electrode means located at least partially in said insulating housing for imparting an electrical charge to the wire of opposite polarity to that of the metallic ions, said second electrode means creating a second charging area in said insulating housing that is isolated from the first charging area resulting from said first electrode means.

2. A wire plating machine as claimed in claim 1 wherein said first electrode means includes two lines of longitudinal conductor segments located toward respective side walls of the tank and said first electrode further includes lateral metallic conductors connected between the two lines of longitudinal conductor in ladder function, said source of electrical potential being connected with all of said longitudinal conductor segments.

3. A wire plating machine as claimed in claims 1 or 2 wherein said means for insulating is an insulating pad positioned between the bottom of said conductors and the bottom of the tank.

4. A wire plating machine as claimed in claims 1 or 2 wherein said means for insulating is an insulating coating located over all of the surfaces of the conductors except for the raised areas.

5. A wire plating machine as claimed in claim 1 further including:

a wiper means positioned at the end of the tank from which the wire exists the bath for wiping electrolyte from the wire, and a rinse means positioned beyond said wiper means for directing a flow of neutralizing liquid onto the wire, said wiper means and rinse means being located between the end of the tank and the means for moving the wire.

6. A wire plating machine as claimed in claim 5 further including:

a reservoir connected to receive liquid from the continuous electrolyte bath and the wiper means, and a pump means for recirculating liquid from the reservoir to the continuous bath.

7. A wire electroplating machine comprising:

an electrolyte bath contained in a tank with a bottom, two side walls and two end walls;

means for moving the wire through said electrolyte bath;

a first electrode means located in said bath so as to create a first charging area and providing metallic ions having an electrical charge of one polarity;

a plurality of first aligned insulating housing located in said bath along one substantially straight path of the wire such that the wire passes through the first housings without substantial deviation from the straight path and without permitting a substantial number of metallic ions to enter the first housings;

a plurality of second aligned insulating housings located in said bath along another substantially straight path of the wire such that the wire passes through the second housings without substantial deviation from the straight path and without permitting a substantial number of metallic ions to enter the second housings; and second electrode means located at least partially in each of said first and second insulating housings for imparting an electrical charge to the wire of opposite polarity to that of the metallic ions, said second electrode means creating a second charging area in each of said first and second insulting housings that is isolated from the first charging area resulting from said first electrode means, said means for moving the wire causing the wire to move first through the first aligned housings and then to move through the second aligned housings.

8. A wire plating machine as claimed in claims 5 or 7 wherein each of said insulating housings comprises:

a metallic hollow tube supported such that it extends from above the bath level to a position below the bath level and just above the wire, the exterior surface of the tube which is below the bath level being completely coated with an insulating material, and a block of insulating material situated over the end of the tube in the bath and in the path of the movement of the wire, said block defining a cavity that communicates with the hollow interior of the tube, said block also having a longitudinal channel by means of which the wire enters and leaves the block, grommet means being provided in the longitudinal channel at the entrace and exit points of the wire for reducing the flow of the continuous electrolyte bath into the channel and cavity so as to reduce the number of metallic ions therein.

9. A wire plating machine as claimed in claim 8 further including means for applying electrical potential to said tube.

10. A wire plating machine as claimed in claim 9 wherein said means for applying comprises first longitudinal metallic members connected to a voltage potential and supported above the bath, said hollow tubes being in electrical contact with and supported by said longitudinal metallic members.

11. A wire plating machine as claimed in claim 10 wherein the voltage potential is derived from a second longitudinal metallic member connected by spaced cross bars to said first longitudinal members in ladder fashion and wherein the second electrode means includes, for each tube, an elongated metallic member slideably located in said tube so as to ride upon the portion of the wire within the cavity of the insulating housing, said elongated metallic member being electrically connected to said second longitudinal member by a shunt strap.

12. A wire plating machine as claimed in claim 11 further including a removable upper cover made of a flexible elastic material and supported by angle brackets from the upper edges of the side walls, and exhaust vents located in said cover for conducting away vapors in the tank.

13. A wire plating machine as claimed in claims 1 or 7 wherein said wire is copper, said first electrode provides positive ions and said second electrode imparts a negative electrical charge to the wire.

14. A wire plating machine as claimed in claim 7 wherein the first insulating housings and the second insulating housings are evenly spaced.

15. A wire plating machine as claimed in claim 7 wherein the first insulating housings and the second insulating housings are unevenly spaced.

16. A wire plating machine as claimed in claim 7 wherein said means for moving the wire comprises an intermediate drawing machine capable of drawing the wire down to a new and different gauge, said drawing machine being positioned to receive the wire at least after it has passed through said first aligned insulating housings in said bath.

17. A wire plating machine as claimed in claim 16 wherein said intermediate drawing machine capable of drawing the wire down to a new and different gauge further receives the wire after it has passed through said second aligned insulating housings in said bath.

18. A wire plating machine as claimed in claims 1 or 7 wherein the interior walls of said tank are covered with an insulation coating.

* * * * *